US005839129A

United States Patent [19]

Lee

[11] Patent Number: 5,839,129

[45] Date of Patent: Nov. 24, 1998

[54] CLEANING WATER SUPPLY DEVICE FOR A TOILET

[76] Inventor: Duk Un Lee, 19-291, Yongsan-dong 5-Ka, Yongsan-Ku, Seoul, Rep. of Korea

[21] Appl. No.: 951,551

[22] Filed: Oct. 16, 1997

[30] Foreign Application Priority Data

Oct. 18, 1996 [KR] Rep. of Korea ..... 1996 46658

[51] Int. Cl.[6] ..... A61H 35/00

[52] U.S. Cl. ..... 4/448; 4/420.2; 4/420.4

[58] Field of Search ..... 4/420.2, 420.4, 4/447, 448

[56] References Cited

U.S. PATENT DOCUMENTS

| | | | |
|---|---|---|---|
| 1,949,415 | 3/1934 | Guidetti et al. | 4/447 |
| 4,926,509 | 5/1990 | Bass | 4/448 |
| 5,572,748 | 11/1996 | Nee | 4/420.2 |

*Primary Examiner*—Robert M. Fetsuga
*Assistant Examiner*—Tuan N. Nguyen
*Attorney, Agent, or Firm*—Pandiscio & Pandiscio

[57] ABSTRACT

A cleaning water supply device for a toilet, comprising a bracket 14 having a horizontal portion 10 formed with a downward fixing portion 55 and a vertical portion 12; a valve assembly 28 having a valve stem 30 being mounted inside the vertical portion 12, an inlet pipe 24 and an outlet pipe 26 being connected with a cleaning water supply fine tube 68 extending from a cleaning water supplying tube 56 fixed to the downward fixing portion 55 of said bracket 14; and a cleaning water nozzle pipe 66 having an upward nozzle tip 64; wherein said cleaning water supplying device comprising a cover 46 having an outwardly arched guide gate 48, an inwardly arched guide gate 50, a horizontal guide gate 52, and a slot 76; a rotative manipulating plate 32 having a fitting plate portion 34 which is fixedly engaged with the valve stem 30; a rotating bracket 42 being rotatively mounted by shaft 44 to the rotative manipulating plate 32 and having a recessed end 40 and a lever 54 guidably shifting through the guide gates 48, 50, 52; a nozzle block 62 having the cleaning water nozzle pipe 66 connected at the lower portion; a rotating guide member 73 having a horizontal plate 72 and a vertical plate 70 on which a shaft pin 74 is mounted; a reciprocating guide rod 80 having an engaging means 86 with which the shaft pin 74 is engaged and a downwardly arched extension rod 82 engaged with the recessed end 40 of rotating bracket 42 through the slot 76 of cover 46.

2 Claims, 6 Drawing Sheets

CLEANING WATER SUPPLY DEVICE FOR A TOILET

BACKGROUND OF THE INVENTION

The present invention relates to a cleaning water supply device for a toilet, particularly to the cleaning water supply device for a toilet in which by using a cleaning water supply lever enabling to adjust supply of cleaning water and the supply quantity of cleaning water, a cleaning water nozzle can be shifted to a usable position in the middle of a toilet bowl and an unusable position in one side of the toilet bowl.

In general, there are two types in the cleaning water supply device for a toilet. One type is that the cleaning water nozzle is fixedly placed in the rear side of the bowl or one position of the both sides to supply cleaning water to the private parts at the fixed degree. Another type is that when the cleaning water nozzle is not used, the nozzle is retreated to the unusable position, and when supply of cleaning water is necessary, the cleaning water nozzle is shifted to the middle position of the toilet bowl. In case of the latter type, a cleaning water nozzle assembly comprises a structure which is generally mounted in the rear side of the toilet bowl, and when cleaning water is supplied, the cleaning water nozzle is extended to the middle position of the toilet bowl, and when supply of cleaning water is interrupted, the nozzle is constricted and shifted to the rear side. Accordingly, the conventional nozzle has the drawbacks which a construction for constricting the cleaning water nozzle is very complicated and frequently broken.

SUMMARY OF THE INVENTION

An object of the present invention is to provide a cleaning water supply device for a toilet in which, to get rid of the above mentioned drawbacks, a cleaning water nozzle can be shifted to a usable position in the middle of a toilet bowl and an unusable position in one side of a toilet bowl.

Another object of the present invention is to provide the cleaning water supply device for a toilet in which supply of cleaning water and adjustment of the supply quantity can be adjusted in a usable position and an unusable position each of the cleaning water nozzle.

Still another object of the present invention is to provide the cleaning water supply device for a toilet in which shifting of the cleaning water nozzle, supply of cleaning water and adjustment of the supply quantity can be achieved by one cleaning water supply lever assembled into a cleaning water supply valve assembly.

A further object of the present invention is to provide the cleaning water supply device for a toilet in which the cleaning water nozzle can be selectively supplied by cold water and hot water.

DETAILED DESCRIPTION OF THE PREFERRED EMBODIMENT

Hereinafter, the present invention will be described in more detail with reference to the accompanying drawings.

Figure 1:
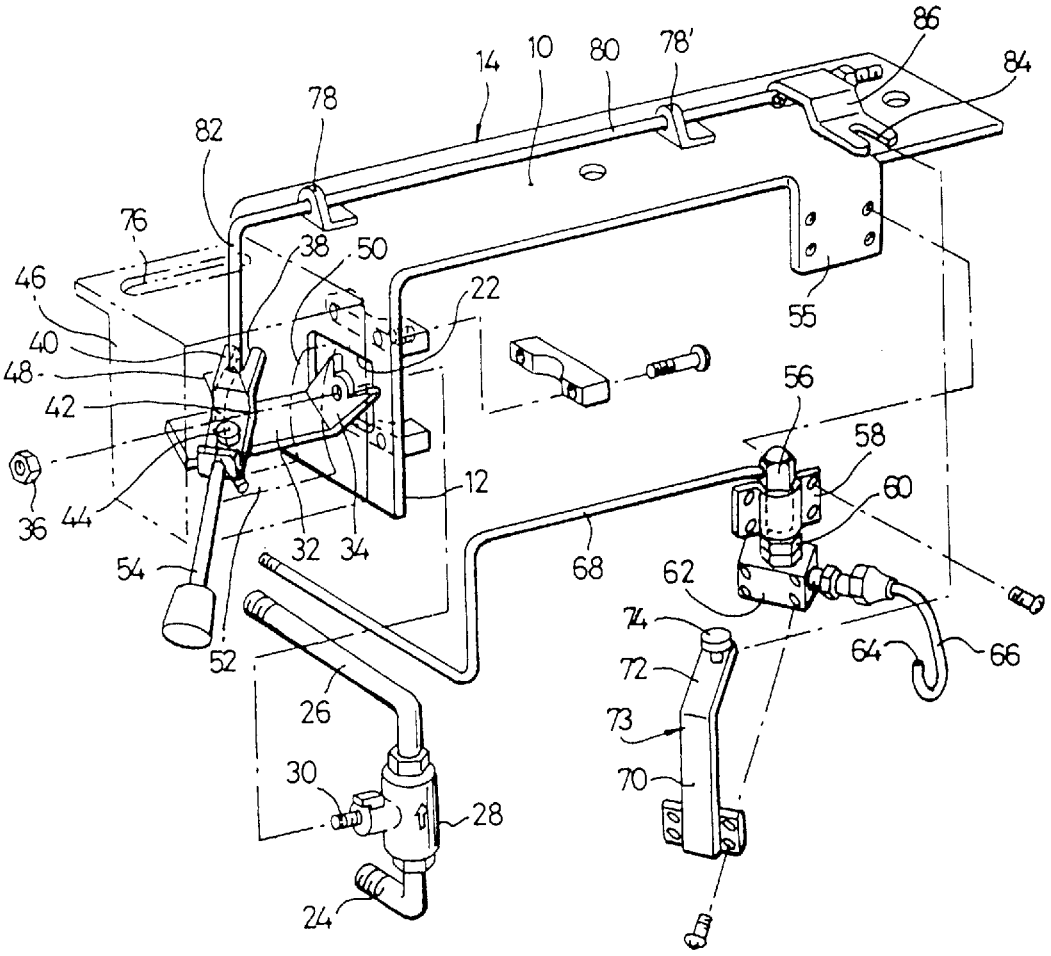
FIG. 1 is a perspective view illustrating a cleaning water supply device for a toilet according to the present invention.
Figure 1A:
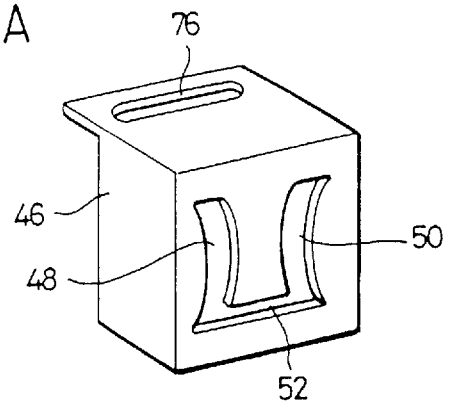
FIG. 1A is a perspective view illustrating a cover guiding the position of a lever.
Figure 2:
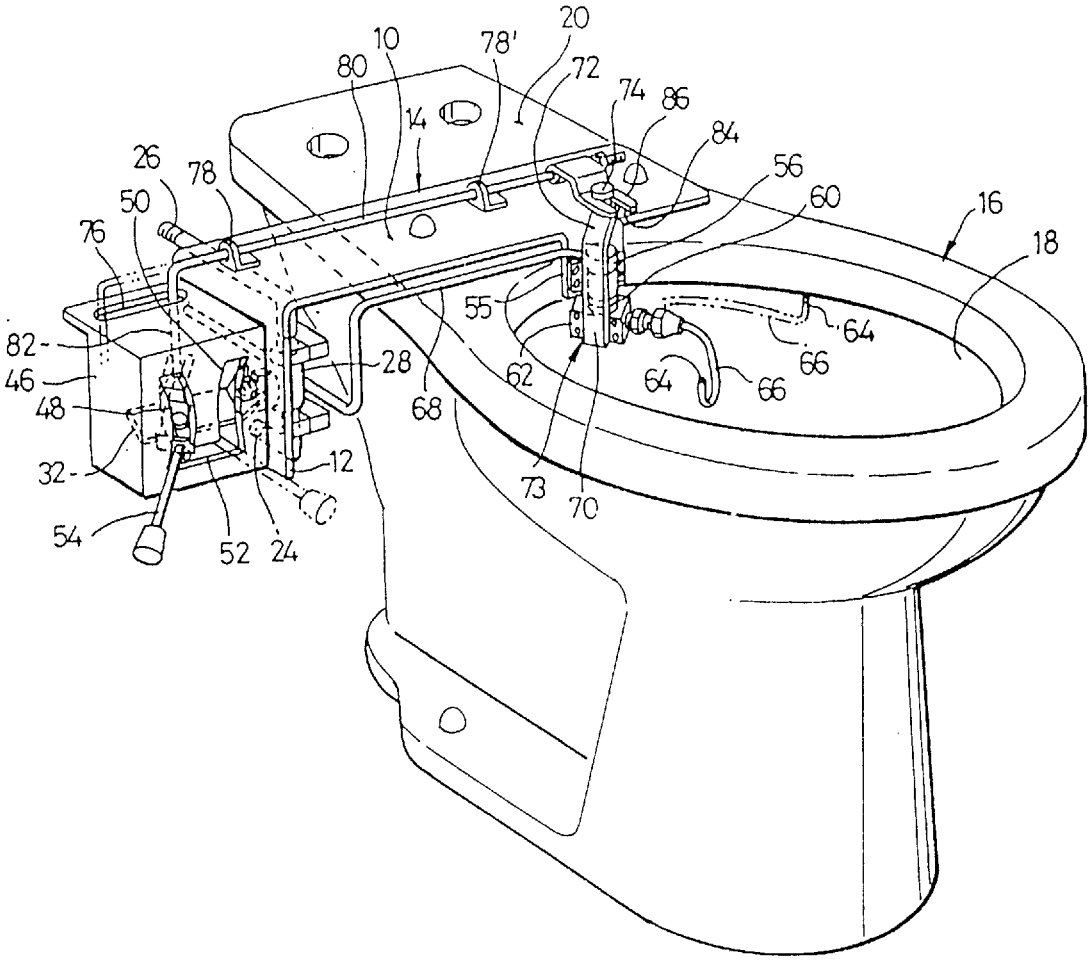
FIG. 2 is a perspective view illustrating the present invention mounted on a toilet in which a cleaning water nozzle placed in a usable position is shown in a solid line and the cleaning water nozzle placed in an unusable position is shown in a dot line.

In FIG. 1 and FIG. 2, a bracket 14 having a horizontal portion 10 and a vertical portion 12 downwardly extended from the one side of the horizontal portion 10 is fixed on an upper surface 20 extended from a bowl 18 of a toilet 16 to the rear side along the upside portion. At the vertical portion 12 of the bracket 14 a square hole 22 is formed in the middle, on the inner surface of the vertical portion 12 a valve assembly 28 having an inlet pipe 24 and an outlet pipe 26 to which hot water is supplied from a hot water supply device (not shown) or cleaning water is supplied from a cleaning water source without the hot water supply device, is mounted, and a valve stem 30 of the valve assembly 28 is extended to the outside of the vertical portion 12 through the square hole 22.

In the valve stem 30 of the valve assembly 28 from the outside of the vertical portion 12 a fitting plate portion 34 vertically extended to the one side end of a rotative manipulating plate 32 extended in a parallel direction to the axis of the valve stem 30 is engaged and fixed with a nut 36.

Also, in the middle of the rotative manipulating plate 32 fixedly engaged with the valve stem 30 of the valve assembly 28 a rotating bracket 42 having a recessed end 40 forming U-shaped recess 38 at the rear end is mounted rotatively to a shaft 44. In the vertical portion 12 of the bracket 14 a cover 46 completely wrapping the rotative manipulating plate 32 is mounted. In the front surface of the cover 46 an outwardly arched guide gate 48 and an inwardly arched guide gate 50 are formed, at the lower side of the gates 48, 50 a horizontal guide gate 52 passing through the gates is formed, and the rear end of a lever 54 is inserted from the front surface guidably through the guide gates 48, 50, 52 and fixedly engaged with the upper end of the rotating bracket 42 rotatively mounted in the rotative manipulating plate 32. Accordingly, the lever 54 can be adjusted in front of the cover 46.

Further, in the horizontal portion 10 of the bracket 14 a downward fixing portion 55 extended toward the rear of the bowl 18 of the toilet 16 is integrally formed and to the fixing portion 55 a cleaning water supplying tube 56 is fixed with a fixing means 58. At the lower end of the cleaning water supplying tube 56 a nozzle block 62 is connected rotatively through a rotating joint 60, and to the nozzle block 62 a cleaning water nozzle pipe 66 having an upward nozzle tip 64 is extended. The upward nozzle tip 64 can be shifted to the middle or one side portion of the toilet bowl 18 and will be explained in more detail hereinafter.

At the top of the cleaning water supplying tube 56 a cleaning water supplying fine pipe 68 is extended. This pipe 68 is extended along the front surface of the horizontal portion 10 of the bracket 14, again extended curvedly along the vertical portion 12, then extended rearward, and then connected to the outlet pipe 26 of the valve assembly 28 through a connection hose (not shown).

Also, a rotating guide member 73 comprising a vertical plate 70 and a horizontal plate 72 is engaged with the nozzle block 62 rotatively engaged with the lower end of the cleaning water supplying tube 56 to rotate the nozzle block 62. The lower end of the vertical plate 70 of the rotating guide member 73 horizontally extended to the shaft of the cleaning water supplying tube 56 is fixed to the nozzle block 62, at the upper end of the vertical plate 70 the horizontal plate 72 is integrally extended, and at the top of the upper end side a shaft pin 74 is horizontally mounted.

Further, at the upper surface of the cover 46 mounted on the vertical portion of the bracket 14 a slot 76 is formed to the extension direction of the bracket 14 at the rear side, at the top surface of the bracket 14 a reciprocating guide rod 80 is mounted to be reciprocated by fixing guide means 78, 78', and at one side of the reciprocating guide rod 80 a downwardly arched extension rod 82 downwardly extended to the outside of the vertical portion 12 of the bracket 14 and extended through the slot 76 of the cover 46 down is integrally formed.

The downwardly arched extension rod 82 of the reciprocating guide rod 80 is engaged with the U-shaped recess 38 formed at the recessed end 40 of the rotating bracket 42 which the lever 54 was engaged with. At the other side end of the reciprocating guide rod 80 an engaging means 86 forming the U-shaped recess 84 is mounted, and the shaft pin 74 fixed to the vertical plate 72 of the rotating guide member 73 rotating the nozzle block 62 is engaged with the U-shaped recess 84 of the engaging means 86.

Operation of the present invention having such construction is described hereinafter.

Figure 3:
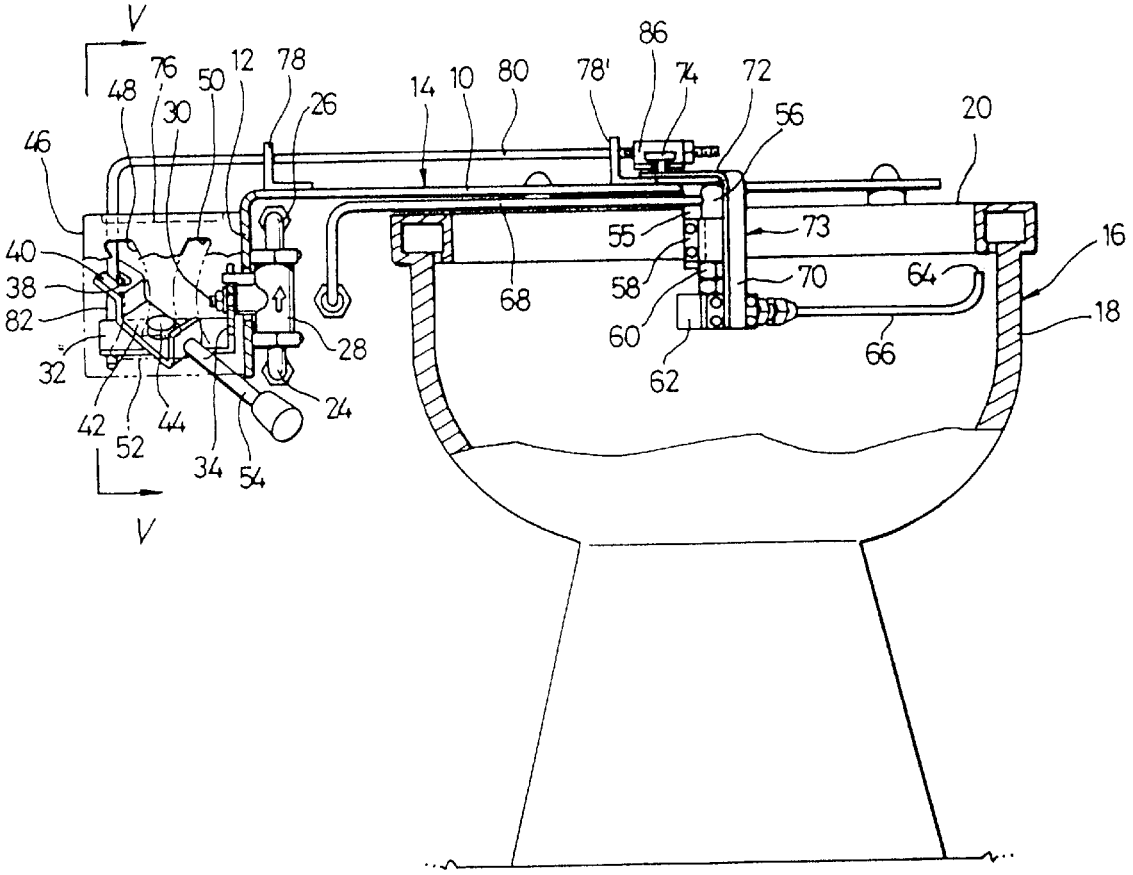
FIG. 3 is a partial front section view illustrating the cleaning water nozzle placed on the unusable position.
Figure 4:
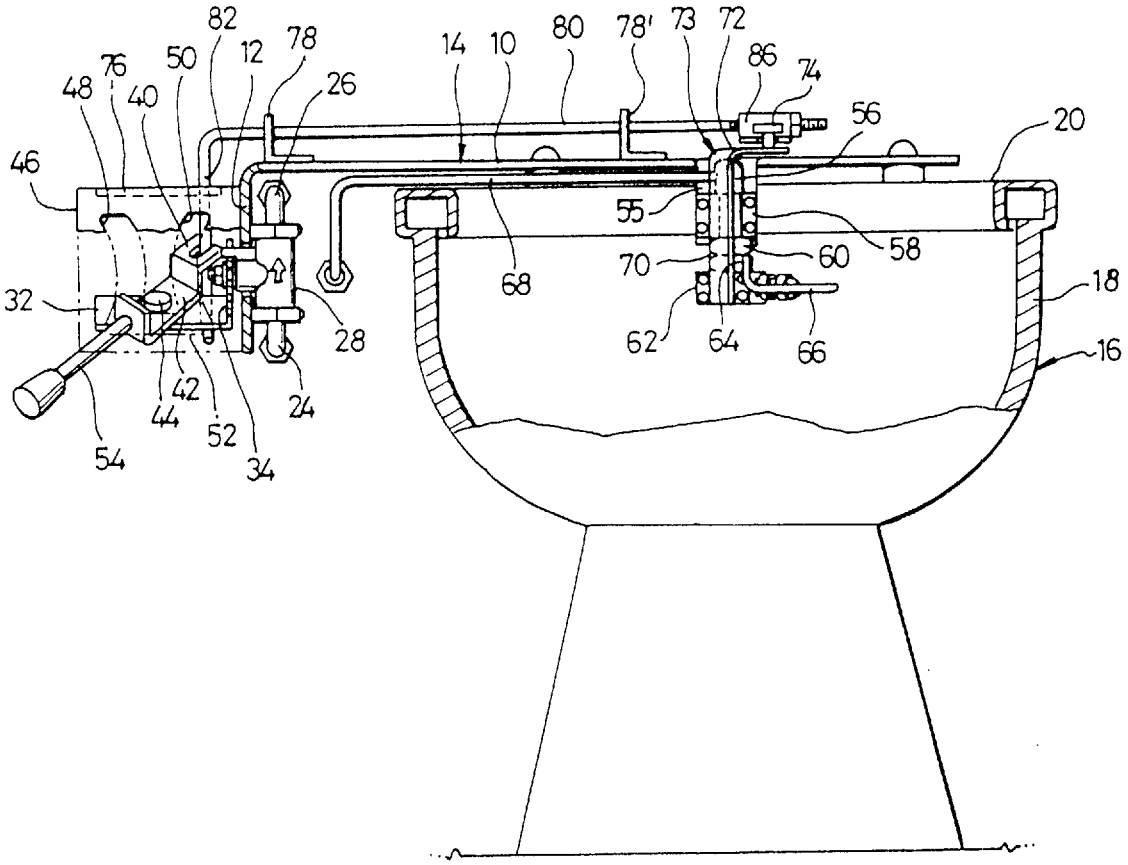
FIG. 4 is a partial front section view illustrating the cleaning water nozzle placed on the usable position. e second example of the present invention.
Figure 5:
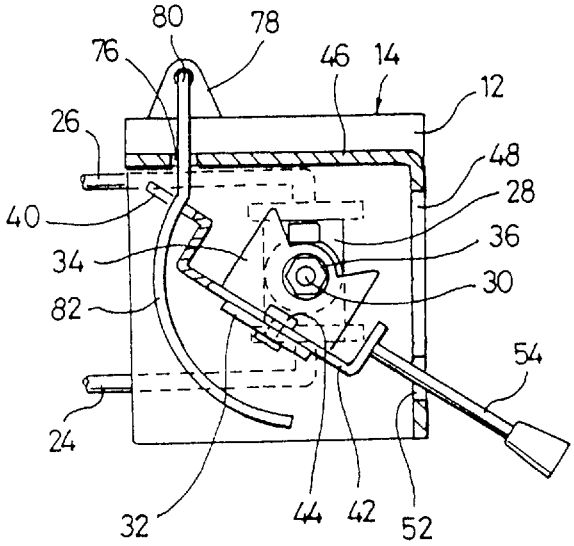
FIG. 5 is a partial section view taken on line V—V of FIG. 3 illustrating the state which the cleaning water nozzle can be shifted to the usable position and unusable position in such a state that cleaning water is not supplied by downward shifting of a cleaning water supply lever.
Figure 6:
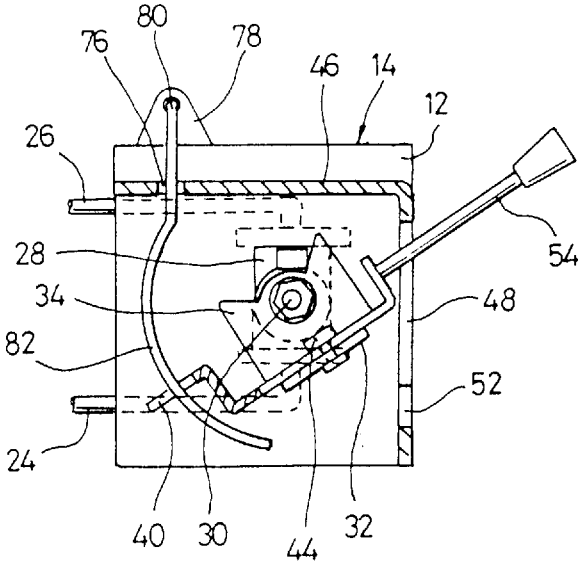
FIG. 6 is a section view similar to FIG. 5 illustrating the state which cleaning water is supplied by upward shifting of the cleaning water supply lever.

In FIG. 2 to FIG. 4, illustration of an water tank, a sitting board, a bowl cover, etc., was omitted to briefly explain the present invention. A person skilled in the field of the present invention will understand the present invention without difficulties from the explanation thereof without illustration of such auxiliary construction. Of course, instead of the water tank, a flush valve can be connected to the toilet 16. Further, as mentioned hereinbefore, the present invention is explained on the grounds that a hot water supply device is used as a cleaning water supplying source. However, the present invention is not restricted by such cleaning water supplying source.

The person who initially uses the toilet will have to prevent the cleaning water nozzle pipe 66 including the cleaning water nozzle tip 64 being polluted by the evacuation and place it in such a state that supply of cleaning water is shut off. To do so, the user downwardly shifts the lever 54 in the sitting state on the toilet 16 and then shifts the horizontal guide gate 52 formed at the front surface of the cover 46 to the lower position of the inwardly arched guide gate 50 (See the dot line portion of the lever 54 in FIG. 2, and FIG. 3).

The lever 54 herein is restrictedly shifted by the guide gates 48, 50, 52 of the cover 46 mounted at the vertical portion 12 of the bracket 14, and as the rear end of the lever 54 is fixed to the upper end of the rotating bracket 42 of the rotative manipulating plate 32 which the fitting plate portion 34 was fixedly engaged with the valve stem 30 of the valve assembly 28, and the rotating bracket 42 is rotatively mounted on the rotative manipulating plate 32 along the shaft 44, the lever 54 actually rotates centering around the shaft 44 while the lever in the horizontal guide gate 52 of the cover 46 is guidably and horizontally shifted. When the lever 54 is guidably shifted from the outwardly arched guide gate 48 or the inwardly arched guide gate 50 to the up and down vertical direction, as will be explained in more detail hereinafter, the fitting plate portion 34 of the rotative manipulating plate 32 with which the rear end of the lever 54 is engaged through the rotating bracket 42 rotates centering around the axis of the valve stem 30 of the fixedly engaged valve assembly 28 (as will be explained hereinafter, at that time, supply of cleaning water and adjustment of the supply quantity are achieved).

When the lever 54 is shifted from the horizontal guide gate to the inward direction, i.e., the upper side of the inwardly arched guide gate 50, the recessed end 40 formed at the rear end of the rotating bracket 42 engaged with the rear end of the lever 54 is shifted to the opposite direction of the lever 54 shifting direction and at the same time the downwardly arched extension rod 82 of the reciprocating guide rod 80 engaged with the U-shaped recess 38 formed at the recessed end 40 is shifted to the outside (to the left in a drawing). Accordingly, the reciprocating guide rod 80 is shifted to the left and by shifting the engaging means 86 mounted on the right side end of the reciprocating guide rod 80 to the left, the rotating guide member 73 engaged with the U-shaped recess 84 of the engaging means 86 by means of the shaft pin 74 rotates counterclockwise from the plane. The rotating guide member 73 comprises a vertical plate 70 and a horizontal plate 72 in which the shaft pin 74 is mounted, and the nozzle block 62 which the lower end of the vertical plate 70 is engaged with the lower end of the cleaning water supplying tube 56 through the rotating joint 60 rotates counterclockwise. Consequently, the cleaning water nozzle pipe 66 mounted on the rotating joint 60 rotates counterclockwise so that the upward nozzle tip 64 is shifted to the one side portion of the toilet bowl 18 (See the dot line portion of FIG. 2, and FIG. 3).

Such position of the upward nozzle tip 64 is the unusable position. In this case, the lever is in the downward position. As the fitting plate portion 34 of the rotative manipulating plate 32 which the lever 54 was engaged with is in the state being rotated clockwise, the valve assembly 28 is in such a state that supply of cleaning water is shut off clockwise to the valve stem 30.

In order for the toilet user to wash his or her private parts after the evacuation, at first, the lever 54 which is in the downward position should be pulled upwardly, i.e., to the upper side of the inwardly arched guide gate 50. In this case, the fitting plate portion 34 of the rotative manipulating plate 32 rotates counterclockwise from the left direction of the drawing so as to open the valve assembly 28 through the valve stem 30 engaged with the fitting plate portion 34. At the recessed end of the rotating bracket engaged with the lever 54 the U-shaped recess 38 is shifted along the downwardly arched extension rod 82 of the reciprocating guide rod 80 and thus the position of the reciprocating guide rod 80 is not changed. In this case, hot cleaning water is supplied by the cleaning water supplying source, a water heater to the inlet pipe 24 of the valve assembly 28, so as to force out the cooling cleaning water remaining in the outlet pipe 26 of the valve assembly 28, the connection hose (not shown) connecting the outlet pipe 26 with the cleaning water supply fine pipe 68, the cleaning water supply fine pipe 68, the cleaning water supplying tube 56 and the cleaning water nozzle pipe 66, and at the same time, hot cleaning water is ejected to the upward nozzle tip 64 of the cleaning water nozzle pipe 66 through the aforesaid course.

After the cooling clean water is discharged, the lever 54 is shifted to the lower side of the inwardly arched guide gate 50 of the cover 46, and then shifted from the lower side of the horizontal guide gate to the outside (in such a state that supply of cleaning water is shut off). Shifting the lever 54 from the horizontal guide gate 52 of the cover 46 to the outside, i.e., the lower side of the outwardly arched guide gate 48, the reciprocating guide rod 80 engaged through the downwardly arched extension rod 82 in the U-shaped recess 38 from the recessed end 40 of the rotating bracket 42 in the cover 46 engaged with the lever 54 is shifted to the right, and at the same time the engaging means 86 of the right side end rotates the rotating guide member 73 clockwise from the plane so as to shift the cleaning water nozzle pipe 66 to the middle position of the toilet bowl 18. Consequently, the upward nozzle tip of the cleaning water nozzle pipe 66 is located in the lower side of the private parts portion of the toilet user. This position is the usable position.

After the upward nozzle tip 64 is located in the usable position, the lever 54 is shifted upwardly. Namely, by shifting the lever 54 to the upper side of the outwardly arched guide gate 48, the fitting plate portion 34 of the rotative manipulating plate 32 engaged with the lever 54 is rotated counterclockwise from the left, so as to open the valve assembly 28 again, supply hot cleaning water through the cleaning nozzle pipe 66 and eject the hot cleaning water through the upward nozzle tip 64. The toilet user's private parts are cleaned by cleaning water being ejected from the upward nozzle tip 64.

If the toilet user wants to finish cleaning the private parts, the valve assembly 28 should be closed by shifting the lever 54 to the lower side, and the upward nozzle tip 64 should be shifted to the unusable position, one side portion of the toilet bowl 18 by shifting the lever 54 to the right.

Figure 7:
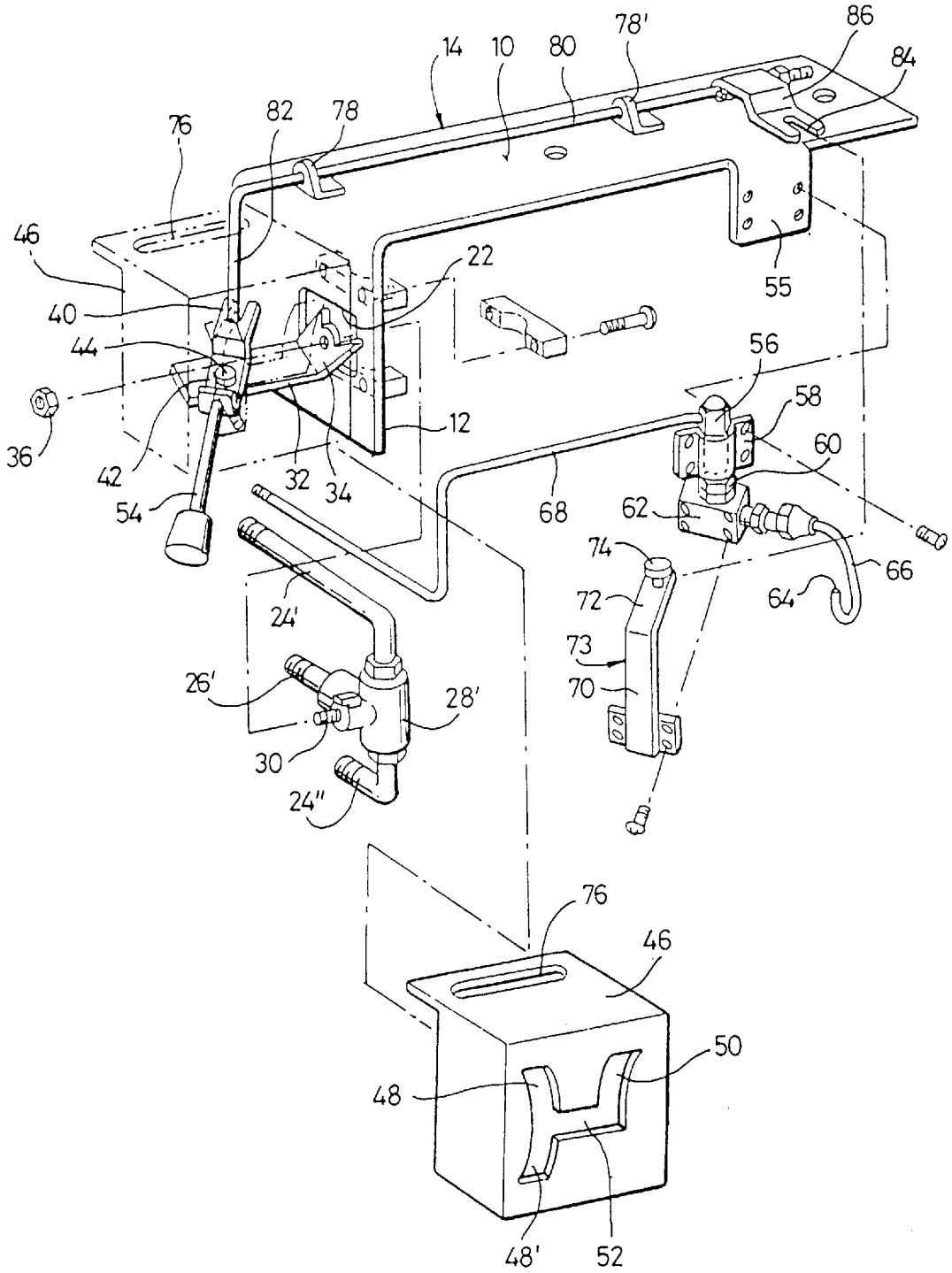
FIG. 7 is an exploded perspective view illustrating the second example of the present invention.

FIG. 7 illustrates the second example of the present invention in which cold water and hot water can be selectively supplied to the cleaning water nozzle pipe 66.

The respects which the second example shown in FIG. 7 is different from the first example mentioned above are that a valve assembly 28' for the selective supply of cold water and hot water comprising a cold water inlet pipe 24', a hot water inlet pipe 24" and an outlet pipe 26' in the middle is used instead of the valve assembly 28 used in the first example, and that a downwardly arched guide gate 48' which the lever 54 is guided to the lower side is formed, so as to supply cold water from the cover 46 to the lower side of the outwardly arched guide gate 48. The other construction parts are identical to those of the first example. Accordingly, the part which are identical to those of the first example was shown in the identical symbolic number.

The second example can be used by connecting the cold water inlet pipe with the cold water supplying source (not shown), connecting the hot water supplying source with the hot water inlet pipe 24", and connecting the outlet pipe 26' in the middle with the cleaning water supply fine pipe 68 extended to the cleaning water nozzle pipe 66. Operation for the supply of hot water is identical to that for the first example. When the user wants to supply cold water, cold water can be supplied to the cleaning water nozzle pipe 66 through which the cold water inlet pipe 24' of the valve assembly 28' is connected with the outlet pipe 26', by shifting the lever 54 to the left of the horizontal guide gate 52 (seen from the drawing) and shifting toward the downwardly arched guide gate 48'.

What is claimed is:

1. A cleaning water supply device for a toilet comprising a bracket having a horizontal portion having a downward fixing portion extended to the downwardly rear direction of a bowl of a toilet at one side end and a vertical portion extended from the other side end of said horizontal portion to the downwardly outside direction of said toilet being fixed at a rear side upper surface of the toilet; a valve assembly having a valve stem being extended to the outside of said vertical portion being mounted inside the vertical portion, an inlet pipe being connected with a cleaning water supplying source, and an outlet pipe being connected with a cleaning water supply fine tube extending from a cleaning water supplying tube fixed to the downward fixing portion of said bracket; and a cleaning water nozzle pipe having an upward nozzle tip at the lower side of the cleaning water supplying tube; a cover which is mounted at the vertical portion of bracket and which has an outwardly arched guide gate, an inwardly arched guide gate, a horizontal guide gate communicating with lower portions of said arched guide gates, and a slot at the upper surface thereof; a rotative manipulating plate having a fitting plate portion which is fixedly engaged with the valve stem of valve assembly; a rotating bracket being rotatively mounted by shaft to the rotative manipulating plate and having a recessed end at the rear end and a lever guidably shifting through the guide gates of the cover at the front end; a nozzle block being rotatively mounted at the lower end of the cleaning water supplying tube and having the cleaning water nozzle pipe connected at the lower portion; a rotating guide member being fixed on the nozzle block and having a horizontal plate and a vertical plate on which a shaft pin is mounted; a reciprocating guide rod, which is reciprocatively mounted at the top of the bracket, having an engaging means with which the shaft pin is engaged and a downwardly arched extension rod engaged with the recessed end of rotating bracket through the slot of cover.

2. A cleaning water supply device for a toilet according to claim 1 wherein the valve assembly comprises a cold water inlet pipe and a hot water inlet pipe, and the outwardly arched guide gate of cover has a downwardly arched guide gate formed toward the lower side thereof.

* * * * *

UNITED STATES PATENT AND TRADEMARK OFFICE

CERTIFICATE OF CORRECTION

PATENT NO. : 5,839,129

DATED : 11/24/98

INVENTOR(S) : Duk Un Lee

It is certified that error appears in the above-indentified patent and that said Letters Patent is hereby corrected as shown below:

Claim 1, column 6, line 28, before the word "bracket", insert the word -- said --;

Claim 1, column 6, line 33, before the words "valve assembly", insert the word -- said --;

Claim 1, column 6, line 34, before the word "shaft", insert the word -- said --;

Claim 1, column 6, line 46, before the word "rotating", insert the word -- said --;

Claim 1, column 6, line 47, before the word "cover", insert the word -- said --;

Claim 2, column 6, line 51, after the word "of" and before the word "cover", insert the word -- said --.

Signed and Sealed this

Twentieth Day of April, 1999

*Attest:*

Q. TODD DICKINSON

*Attesting Officer*

*Acting Commissioner of Patents and Trademarks*